United States Patent [19]

Vatterott

[11] 4,430,533

[45] Feb. 7, 1984

[54] ACTUATOR SWITCH ASSEMBLY

[75] Inventor: Oskar F. Vatterott, Pacific, Mo.

[73] Assignee: MCIBS, Inc., Clayton, Mo.

[21] Appl. No.: 325,095

[22] Filed: Nov. 27, 1981

[51] Int. Cl.[3] ..... H01H 3/16

[52] U.S. Cl. ..... 200/61.41; 200/16 B; 200/243

[58] Field of Search ..... 200/61.41, 61.42, 61.43, 200/61.44, 52 R, 16 B, 61.73

[56] References Cited

U.S. PATENT DOCUMENTS 2,794,879 6/1957 Clason ..... 200/243 X 2,819,361 1/1958 Grace ..... 200/61.42

3,270,329 8/1966 Schnell ..... 200/61.41 X

*Primary Examiner*—E. A. Goldberg

*Assistant Examiner*—Morris Ginsburg

*Attorney, Agent, or Firm*—Cohn, Powell & Hind

[57] ABSTRACT

This actuator switch assembly is used in conjunction with a concrete block machine and provides first and second switch portions, each attached to one of the height pins of the concrete block machine. Both switch portions include spring-loaded plungers and one of the portions includes a pair of electrical contacts which are closed by engagement of the plungers when the height bars approach each other.

5 Claims, 4 Drawing Figures

ACTUATOR SWITCH ASSEMBLY

BACKGROUND OF THE INVENTION

This invention relates generally to actuator switch assemblies and particularly to an actuator switch assembly used in conjunction with a concrete block machine.

Concrete block machines, of this type with which this switch assembly is used, include height pins which provide limit stops to predetermine the height of the finished concrete blocks produced by the machine. The height pins also provide electrical contacts which control the vibration cycle of the block machine and can also be used to initiate extension and retraction of core puller assemblies which are sometimes used with concrete block machines, as described in copending application Ser. No. 325,096.

Concrete block machines are subject to extremely heavy vibration cycles during the formation of the blocks which adversely affect the performance of the height pins, when used as electric contacts. In addition, the likelihood of concrete dust and other material being deposited on the contact faces of the height pins tends to impair the efficiency of these members as electrical contacts.

The present actuator switch assembly solves these and other problems in a manner not disclosed in the known prior art.

SUMMARY OF THE INVENTION

This actuator switch assembly provides a substantially vibration proof and dirt proof switch which can withstand the vibrations and dusty environment commonly associated with concrete block machines.

The actuator assembly is for use with a concrete block machine having two relatively movable parts such as height pins which determine the height of the concrete blocks to be produced by the machine. More specifically, the actuator switch assembly includes a first switch portion attached to one of said height pins in adjustable relation; a second switch portion attached to the other of said height pins, at least one of said switch portions including a spring-loaded plunger engageable with the other of said switch portions, and one of said switch portions including a pair of electrical contacts selectively closed by operative engagement between said plunger of one portion and the other portion.

It is an aspect of this invention to provide a first switch portion which includes a bracket attached to the associated height pin; a housing attached to the bracket in threadedly adjustable relation; and a spring-loaded plunger slidably mounted in the housing. It is another aspect of this invention to provide a second switch portion which includes a bracket attached to the associated height pin, a housing attached to the bracket; and a spring-loaded plunger slidably mounted in the housing and engageable with the spring-loaded plunger of the first portion.

Yet another aspect of this invention is to provide that the second switch portion includes the electrical contacts and a conductor plate, operatively disposed between the end of the associated plunger and the electrical contacts.

Another aspect of this invention is to provide that the spring loading of the first switch portion plunger is greater than that of the second switch portion plunger.

Still another aspect of this invention is to provide a first switch portion which includes an inner portion clampable to its associated height pin in adjustable relation, and an outer portion having a pair of jaws defining a threaded groove receiving the threaded housing in adjustable relation.

DESCRIPTION OF THE PREFERRED EMBODIMENT

Figure 1:
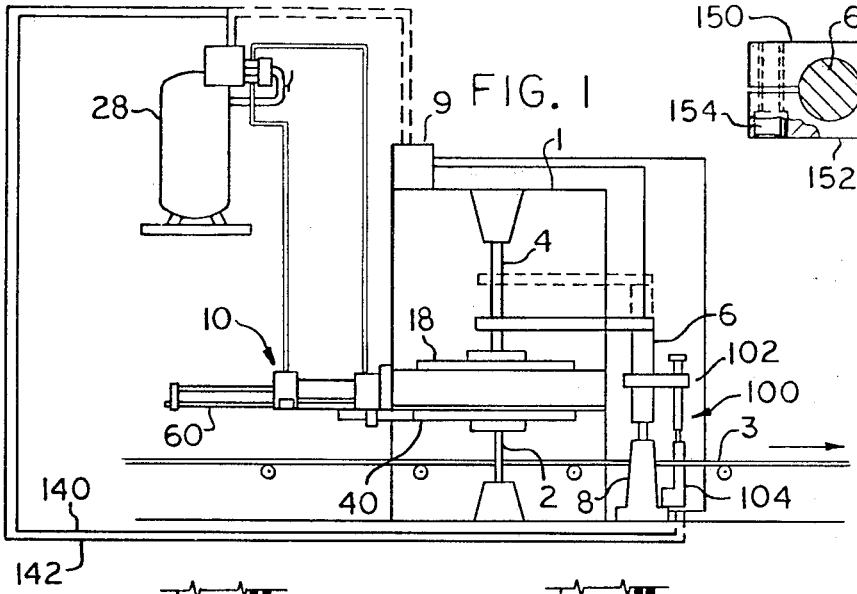
FIG. 1 is a schematic arrangement of the block machine illustrating the height pins and the actuator switch assembly.

Referring now by reference numerals to the drawing and first to FIG. 1 it will be understood that the actuator switch assembly generally indicated by numeral 100 can be used in conjunction with a concrete block machine 1 for actuating a core puller assembly 10 which is used to extend and retract core bars 60 from a mold assembly 18 such as is disclosed in copending U.S. patent application Ser. No. 325,096.

Figure 4:
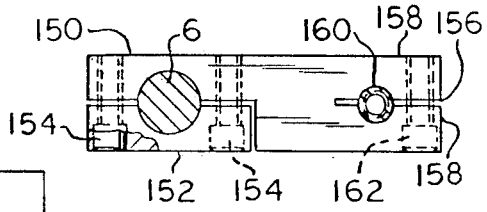
FIG. 4 is a plan view thereof taken on line 4—4 of FIG. 2.
Figure 3:
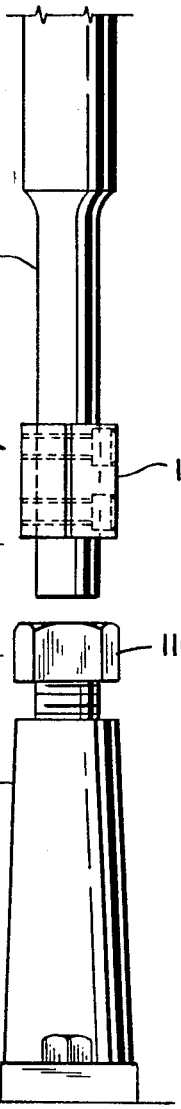
FIG. 3 is an end view thereof.

Block machine of the type with which the core puller assembly 10 is used are shown schematically in FIG. 1. The block machine 1 is supplied with pallets 40 by a conveyor 3. The pallets 40 are raised into position, as by a lower lift unit 2. The molds are filled as by a metering chute (not shown) and an upper stripper head unit 4, having a movable upper height pin 6 connected thereto is lowered into position until the height pin 6 engages a relatively fixed lower height pin 8. The height pins 6 and 8 determine the height of the blocks produced by the machine and also provide electrical contacts, which close to initiate termination of the vibration cycle and also actuate the stripping action of the head unit 4 by way of the delay timer 9. The delay timer 9 can also be used to send a signal to the pneumatic drive assembly 28 of core puller assembly 10 so that the core bars are retracted prior to the stripping action. The actuator switch assembly 10 provides an alternative switching means for the core puller drive assembly 28 which operates independently of the block machine delay timer 9 as will now be described with references to FIGS. 2, 3 and 4.

Figure 2:
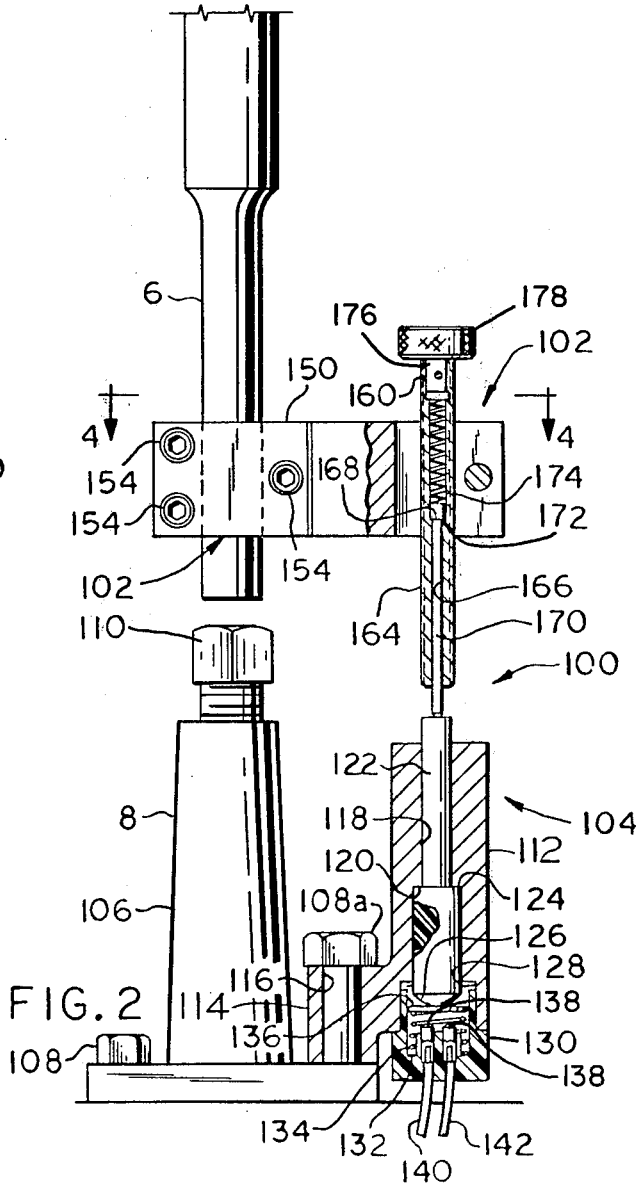
FIG. 2 is an elevational view of the actuator switch assembly partly in cross-section.

The actuator switch assembly 100 consists essentially of an upper plunger assembly 102 mounted to the upper height pin 6 and lower plunger assembly 104 mounted to the lower height pin 8 constituting first and second switch portions respectively. As shown in FIG. 2, the lower height pin 8 consists essentially of a bottom member 106 fixedly attached to the block machine 1 as by bolt 108 and having a height adjustable member 110 threadedly attached at the upper end thereof.

The actuator switch lower plunger assembly 104 includes a housing 112 having an integrally formed bracket 114 apertured at 116 for attachment to the height pin bottom member 106 by means of a bolt 108*a*. The housing 112 includes a passage 118 having an intermediate annular abutment 120. A plunger rod 122, of non-conductive material such as plastic, is slidably mounted in said passage 118, said rod having an intermediate annular shoulder 124, engageable with the intermediate abutment 120, and a convex lower end 126. The housing 112 also includes an enlarged lower end portion 128 receiving a closure plug 130. The plug 130 includes a grooved socket 132 housing a compression spring 134, and said spring is provided with a conductor plate 136, which is engageable with, and downwardly movable by the lower end 126 of the plunger rod 122. The plug 130 of non-conductive material such as plastic is apertured to receive a pair of electrical contacts 138, connected to electrical leads 140 and 142, which are electrically interconnected by the conductor plate 136 upon depression of the plunger rod 122.

The upper plunger assembly 102 includes a bracket 150 provided with a clamping plate 152 attached to said bracket by bolts 154, said bracket and said clamping plate being arcuately grooved to receive the upper height pin 6 in clamped relation. The bracket 150 is notched at 156 to define opposed jaw portions 158, said jaw portions 158 being arcuately and threadedly grooved to accept a threadedly adjustable switch member 160, said switch member being clamped to the bracket by means of clamping bolt 162.

The adjustable switch member 160 includes a tubular housing 164 provided with a passage 166 having an intermediate annular abutment 168. The adjustable switch member also includes a spring-loaded plunger rod 170 having an annular shoulder 172, engageable with the abutment 168 and is slidably mounted in said passage 166. A compression spring 174 is disposed within the housing 164 extending between the plunger rod 170 and a plug 176 which is riveted, or otherwise attached, to the upper end of the tubular housing 164. The spring 174 has a spring rate such that it provides the plunger rod 170 with a greater spring loading than is provided plunger rod 122 by spring 134. The plug 176 is provided with a head 178 by which the threaded housing 164 can be rotatably adjusted relative to the bracket 150.

It is thought that the structural features and functional advantages of this actuator switch assembly have become fully apparent from the foregoing description of parts but for completeness of disclosure the operation of the device will be briefly described.

The actuator switch assembly 100 provides a normally open switch which is closed when the upper plunger rod 170 carried by the movable height pin 6, engages and depresses the lower plunger rod 122 carried by the lower height pin 8 so that the conductor plate 136 electrically connects the contacts 138. The actuator switch assembly 100 can be adjusted so that the contacts 138 are closed, within a finite time before the height pins 6 and 8 engage. Coarse adjustment of the switch assembly 100 is effectuated by adjusting and clamping the bracket 150 on the upper height pin 6 at a specific distance above the end of the upper height pin, for example a distance of one inch (1″). Fine adjustment of the switch assembly 100 is effectuated with the upper and lower height pins 6 and 8 respectively engaged, by rotating the threaded switch member 160 of the upper plunger assembly 102 until the upper plunger rod 170 engages the lower plunger rod 122. Continued rotation of the switch member 160 results in depression of the lower plunger rod 120 until the contacts 138 are closed which can readily be checked by a meter in a well-known manner. This condition provides that the switch assembly 100 will be closed whenever the upper height pin 6 is lowered into engagement with the lower height pin 8.

If the upper height pin 6 is now backed off a finite distance from the lower height pin 8 such that the conductor plate 136 is moved away from the contacts 138, the threaded housing can be rotated to move the plunger rod 122 downwardly to take up the space between the conductor plate 136 and the contacts 138 until contacts are again closed. The result of this setting is that the switch assembly 100 will be closed during the descent of the upper height pin 6 and before engagement of the height pin 8. Continued downward movement of the upper plunger assembly 102 relative to the lower plunger assembly 104 results in retraction of the spring-loaded upper plunger rod 170, but the contacts 138 remain closed, overtravel being absorbed by the upper plunger assembly.

An alternative method of adjusting the switch assembly 100 for closure during the downward descent of the upper height pin 6 and before actual engagement of the height pins, is as follows. The height pins 6 and 8 are brought into engagement and the switch member 160 adjusted as before, until the contacts 138 are closed. The switch member 160 can now be rotated one and one-half to two turns further. In both methods the clamping bolt 162 is firmly tightened following adjustment.

As will be understood, the provision of non-conductive materials for the plunger rod 122 and the plug 130 permits the use of 110 v AC supply and does not limit the use of the switch to low voltage DC supply.

I claim as my invention:

1. A machine and actuator switch assembly comprising:

a machine having two relatively movable parts, and an actuator switch assembly including:

a first switch portion attached to one of said relatively movable parts in adjustable relation, the first switch portion having a spring loaded plunger, a second switch portion attached to the other of said relatively moving parts, the second switch portion having a spring loaded plunger engageable with the spring loaded plunger of the first switch portion, and one of said first and second switch portions having a pair of electrical contacts, selectively closed by operative engagement between the spring loaded plunger of the first switch portion and the spring loaded plunger of said second switch portion, the first switch portion includes:

a bracket attached to said one of said relatively movable parts, and a housing attached to the bracket in threadedly adjustable relation, the spring-loaded plunger being slidably mounted in the housing, and the second switch portion includes:

a bracket attached to said other of said relatively movable parts, and a housing attached to the bracket, the spring-loaded plunger being slidably mounted in the housing.

2. A machine and actuator switch assembly as defined in claim 1, in which:

the second switch portion includes the electrical contacts, and the second switch portion includes a conductor plate operatively disposed between the end of the associated plunger and the electrical contacts.

3. A machine and actuator switch assembly as defined in claim 1, in which:

the spring loading of the first switch portion plunger is greater than that of the second switch portion plunger.

4. A machine and actuator switch assembly as defined in claim 1, in which:

the first switch portion bracket includes an inner portion clampable to said one of said relatively movable parts in adjustable relation, and an outer portion having a pair of jaws defining a threaded groove receiving the threaded housing in adjustable relation.

5. A machine and actuator switch assembly as defined in claim 1, in which:

the second switch portion housing includes an end plug of non-conductive material having a socket portion containing a conductor plate, a spring and the electrical contacts, and the second switch portion plunger is of non-conductive material and is operatively engageable with the conductor plate.

* * * * *